US011127366B2

(12) United States Patent
Lee et al.

(10) Patent No.: US 11,127,366 B2
(45) Date of Patent: Sep. 21, 2021

(54) SOURCE DRIVER AND DISPLAY DEVICE

(71) Applicant: Samsung Electronics Co., Ltd., Suwon-si (KR)

(72) Inventors: Ha Jun Lee, Seoul (KR); Jun Ho Song, Hwaseong-si (KR); Jeong Ah Ahn, Hwaseong-si (KR); Eun Jong Jang, Osan-si (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 0 days.

(21) Appl. No.: 16/808,824

(22) Filed: Mar. 4, 2020

(65) Prior Publication Data

US 2021/0012743 A1 Jan. 14, 2021

(30) Foreign Application Priority Data

Jul. 9, 2019 (KR) ..... 10-2019-0082451

(51) Int. Cl.
*G09G 3/36* (2006.01)
*G09G 3/3258* (2016.01)

(52) U.S. Cl.
CPC ..... *G09G 3/3696* (2013.01); *G09G 3/3258* (2013.01); *G09G 3/3685* (2013.01); *G09G 2310/027* (2013.01); *G09G 2310/0291* (2013.01); *G09G 2320/0646* (2013.01); *G09G 2320/0673* (2013.01)

(58) Field of Classification Search
CPC ..... G09G 3/3696; G09G 3/3258; G09G 2320/0673; G09G 2310/0291; G09G 2320/0646; G09G 3/3685; G09G 2310/027; G09G 2330/028; G09G 2310/0289; G09G 3/20
See application file for complete search history.

(56) References Cited

U.S. PATENT DOCUMENTS

| | | | | |
|---|---|---|---|---|
| 7,683,876 | B2 | 3/2010 | Chung | |
| 8,081,150 | B2 | 12/2011 | An | |
| 8,884,677 | B1 | 11/2014 | Huang et al. | |
| 9,390,680 | B2 | 7/2016 | Jeon et al. | |
| 9,601,076 | B2 | 3/2017 | Kim et al. | |
| 2009/0046083 | A1* | 2/2009 | Kim | G09G 3/20 345/204 |
| 2010/0141687 | A1 | 6/2010 | Han et al. | |

(Continued)

*Primary Examiner* — Temesghen Ghebretinsae
*Assistant Examiner* — Ivelisse Martinez Quiles
(74) *Attorney, Agent, or Firm* — Harness, Dickey & Pierce, P.L.C

(57) ABSTRACT

A source driver including a decoder configured to receive image data and an activation signal, determine a target voltage based on the image data, and select at least one gamma line for generating the target voltage from among a plurality of gamma lines, which are configured to transmit different gamma voltages, respectively, and a buffer circuit including a plurality of input terminals and configured to be connected to the selected at least one gamma line and generate an output voltage based on at least one gamma voltage obtained from the selected at least one gamma line may be provided. The decoder may be further configured to select a gamma line group including the selected at least one gamma line to be connected to the plurality of input terminals of the buffer circuit during a slew period of the buffer circuit in accordance with the activation signal.

20 Claims, 14 Drawing Sheets

(56) References Cited

U.S. PATENT DOCUMENTS

| | | | | |
|---|---|---|---|---|
| 2011/0175943 | A1 | 7/2011 | Ahn et al. | |
| 2012/0206506 | A1 | 8/2012 | Kim et al. | |
| 2013/0342520 | A1* | 12/2013 | Tsuchi | G09G 3/3688 345/211 |
| 2019/0304395 | A1* | 10/2019 | Kim | G09G 3/3696 |

* cited by examiner

FIG. 9

| VG_TG | Region |
|---|---|
| VG0<br>VG1<br>⋮<br>VG30<br>VG31 | Full DEC |
| VG32<br>⋮<br>VG223 | Half DEC |
| VG224<br>VG225<br>⋮<br>VG254<br>VG255 | Full DEC |

FIG. 10

| VG_TG | VH(FS_EN High) | VH(FS_EN Low) |
|---|---|---|
| | VL(FS_EN High) | VH(FS_EN Low) |
| VG0 | VG 1 | VG 0 |
| | VG 0 | VG 0 |
| VG1 | VG 1 | VG 1 |
| | VG 0 | VG 1 |
| VG254 | VG255 | VG254 |
| | VG254 | VG254 |
| VG255 | VG255 | VG255 |
| | VG254 | VG255 |

| VG_TG | VH(FS_EN High) | VH(FS_EN Low) |
|---|---|---|
| | VL(FS_EN High) | VH(FS_EN Low) |
| VG128 | VG128 | VG128 |
| | VG126 | VG128 |
| VG129 | VG130 | VG130 |
| | VG128 | VG128 |
| VG130 | VG130 | VG130 |
| | VG128 | VG130 |
| VG131 | VG132 | VG132 |
| | VG130 | VG130 |

SOURCE DRIVER AND DISPLAY DEVICE

This application claims priority under 35 U.S.C. § 119 to Korean Patent Application No. 10-2019-0082451, filed on Jul. 9, 2019 in the Korean Intellectual Property Office, the disclosure of which is incorporated herein in its entirety.

BACKGROUND

1. Technical Field

The present inventive concepts relate to a source driver and a display device, and more particularly, to a source driver for variably selecting a gamma voltage to be applied to the input terminal of a buffer circuit during the slew period of the buffer circuit and a display device including the source driver.

2. Description of the Related Art

Examples of a display device that can be used in an electronic device for displaying an image such as a television (TV), a laptop computer, a monitor, and a mobile device include a liquid crystal display (LCD) device, an organic light-emitting diode (OLED) display device, and the like. The display device may include a display panel which includes a plurality of pixels and a display driver which applies electrical signals to the plurality of pixels, and the display device may realize an image in accordance with the electrical signals. Recently, various research has been conducted on ways to improve the performance of the display device in terms of, for example, resolution, slew rate, and the like.

SUMMARY

Some example embodiments of the present inventive concepts provide a source driver with improved operating characteristics.

Some example embodiments of the present inventive concepts provide a display device with improved operating characteristics.

However, some example embodiments of the present inventive concepts are not restricted to the example embodiments set forth herein. The above and other aspects of the present inventive concepts will become more apparent to one of ordinary skill in the art to which the present inventive concepts pertain by referencing the detailed description of the example embodiments of the present inventive concepts given below.

According to an example embodiment of the present disclosure, a source driver includes a decoder configured to receive image data and an activation signal, determine a target voltage based on the image data, and select at least one gamma line for generating the target voltage from among a plurality of gamma lines, the plurality of gamma lines being configured to transmit different gamma voltages, respectively, and a buffer circuit including a plurality of input terminals, the buffer circuit configured to be connected to the selected at least one gamma line, the buffer circuit further configured to generate an output voltage based on at least one gamma voltage obtained from the selected at least one gamma line may be provided. The decoder may be further configured to select a gamma line group including the selected at least one gamma line, to be connected to the plurality of input terminals of the buffer circuit during a slew period of the buffer circuit in accordance with the activation signal.

According to an example embodiment of the present disclosure, a source driver includes a decoder that is configured to receive image data and an activation signal, determine a target voltage based on the image data, receive a plurality of gamma voltages having different levels, and select a gamma voltage, from among the plurality of gamma voltages, to be output based on the activation signal and the target voltage, and a buffer circuit including a plurality of input terminals to which the gamma voltage is applied, and configured to generate an output voltage based on the gamma voltage. The decoder may be further configured to select a first voltage group in a first period from a first point in time when a slew period of the buffer circuit begins to a second point in time when the output voltage reaches a reference voltage, the first voltage group including two or more gamma voltages having similar levels from among the plurality of gamma voltages, and select a second voltage group in a second period from the second point in time to a third point in time when the output voltage reaches the target voltage, the second voltage group including at least one gamma voltage for generating the target voltage from among the plurality of gamma voltages.

According to an example embodiment of the present disclosure, a display device includes a display panel including a plurality of pixels and configured to display an image via the plurality of pixels, a source driver connected to a plurality of gamma lines which transmit different gamma voltages, respectively, the source driver configured to output a gray voltage to the plurality of pixels via a plurality of source lines, and a timing controller configured to output control signals for controlling an operation of the source driver. The source driver may include a decoder that is configured to receive image data and an activation signal from the timing controller, determine a target voltage based on the image data, and select at least one gamma line for generating the target voltage from among the plurality of gamma lines, and a buffer circuit including a plurality of input terminals, the buffer circuit configured to be connected to the selected at least one gamma line, the buffer circuit further configured to generate the gray voltage based on a target gamma voltage obtained from the selected at least one gamma line. The decoder may be further configured to select a gamma line group including the at least one gamma line, to be connected to the plurality of input terminals in a slew period of the buffer circuit in accordance with the activation signal.

BRIEF DESCRIPTION OF THE DRAWINGS

The above and other features of the present inventive concepts will become more apparent by describing in detail some example embodiments thereof with reference to the attached drawings, in which:

FIG. 9 illustrates regions that are classified according to the range of a target gamma voltage, according to an example embodiment of the present inventive concepts.

FIG. 10 illustrates sets of gamma lines selected for each target gamma voltage corresponding to a "Full DEC" region of FIG. 9 during a slew period.

DETAILED DESCRIPTION

While the term "same" or "identical" is used in description of example embodiments, it should be understood that some imprecisions may exist. Thus, when one element is referred to as being the same as another element, it should be understood that an element or a value is the same as another element within a desired manufacturing or operational tolerance range (e.g., ±10%).

When the terms "about" or "substantially" are used in this specification in connection with a numerical value, it is intended that the associated numerical value includes a manufacturing or operational tolerance (e.g., ±10%) around the stated numerical value. Moreover, when the words "generally" and "substantially" are used in connection with geometric shapes, it is intended that precision of the geometric shape is not required but that latitude for the shape is within the scope of the disclosure.

Figure 1:
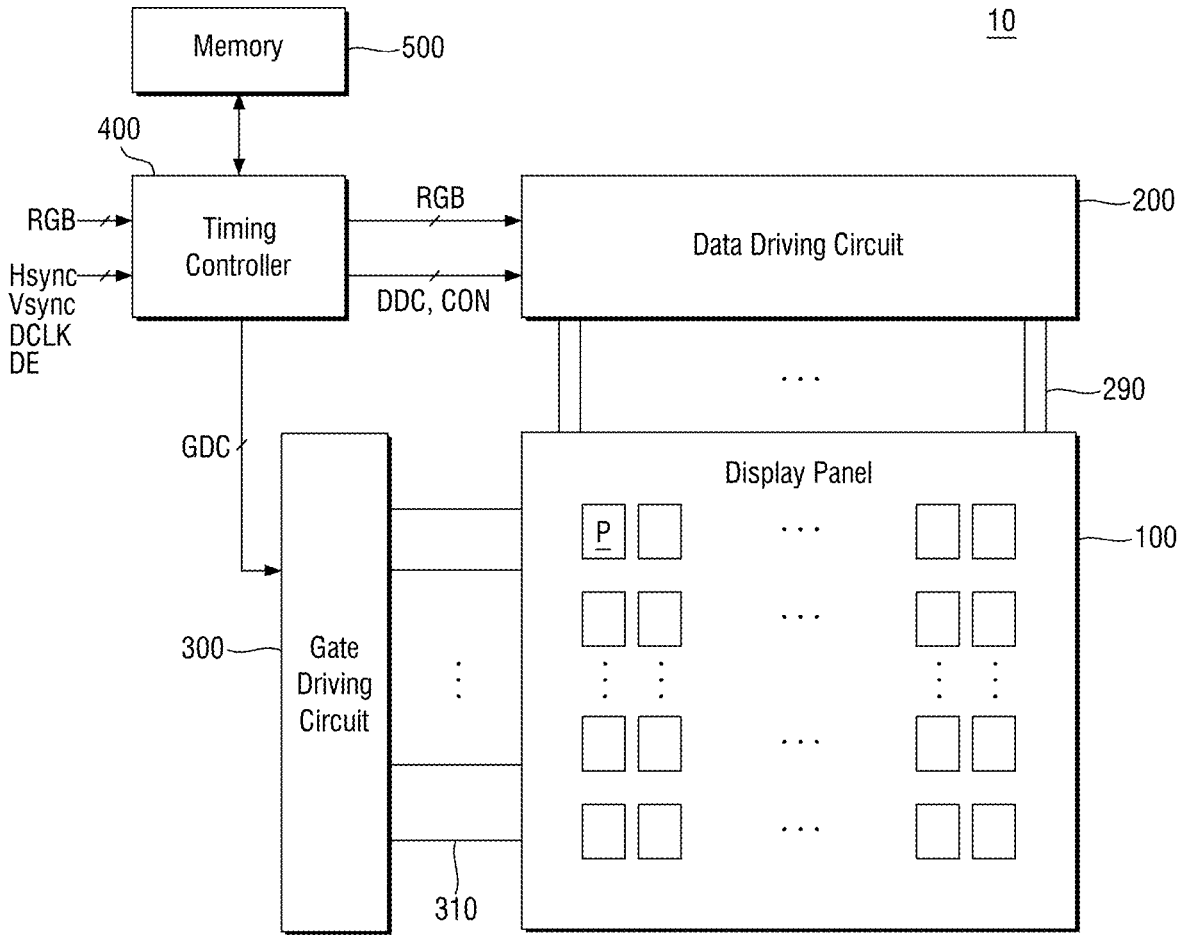
FIG. 1 is a block diagram of a display device according to an example embodiment of the present inventive concepts.
Figure 2:
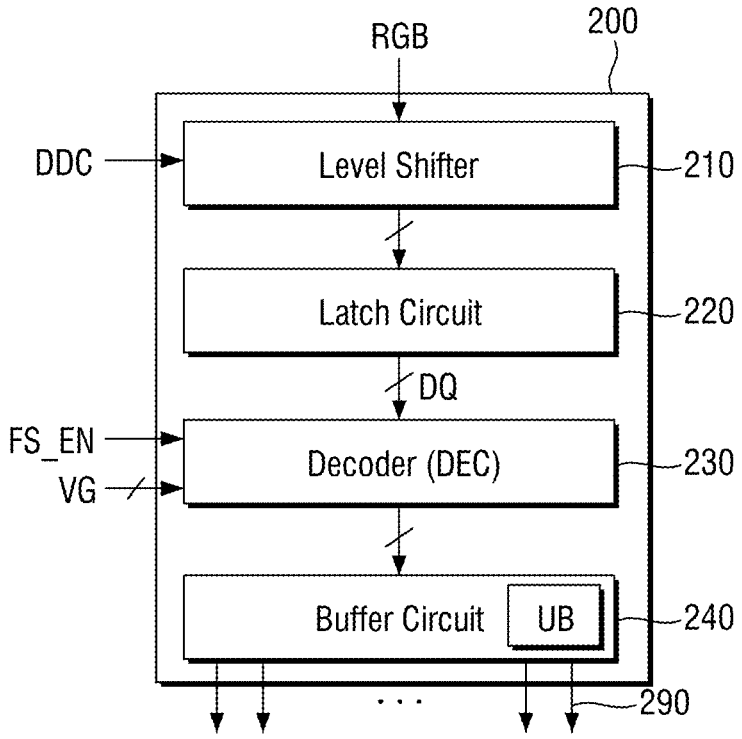
FIG. 2 is a block diagram of a data driving circuit of FIG. 1.
Figure 3:
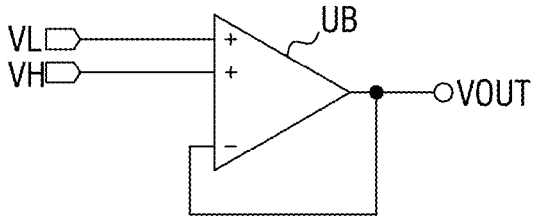
FIG. 3 illustrates a buffer circuit of FIG. 2.

FIG. 1 is a block diagram of a display device according to an example embodiment of the present inventive concepts. FIG. 2 is a block diagram of a data driving circuit of FIG. 1. FIG. 3 illustrates a buffer circuit of FIG. 2.

Referring to FIG. 1, a display device 10 may include a display panel 100, a data driving circuit 200, a gate driving circuit 300, a timing controller 400, and a memory 500.

In the display panel 100, a plurality of data lines 290 and a plurality of gate lines 310 are disposed to intersect, and pixels P are arranged at the intersections between the data lines 290 and the gate lines 310 in a matrix. The display panel 100 may be a flat panel display panel such as a thin-film-transistor liquid-crystal display (TFT LCD) panel, a plasma display panel (PDP), a light-emitting diode (LED) display panel, or an organic LED display panel, but the present inventive concepts is not limited thereto.

Each of the pixels P is connected to one of the data lines 290 and one of the gate lines 310. The pixels P may be electrically connected to the data lines 290 in response to gate pulses input thereto via the gate lines 310, and may thus receive data voltages from the data lines 290. A display operation of the display panel 100 may involve operations of the data driving circuit 200 and the gate driving circuit 300 under the control of the timing controller 400.

During the display operation, the data driving circuit 200 converts digital video data RGB into data voltages for displaying an image in accordance with a data timing control signal DDC applied thereto from the timing controller 400, and provides the data voltages to the data lines 290. The data driving circuit 200 may also be referred to as a source driver 200, and the data lines 290 may also be referred to as source lines 290.

During the display operation, the gate driving circuit 300 generates gate pulses for displaying an image in accordance with a gate control signal GDC, and sequentially provides the gate pulses to the gate lines 310 in a row-sequential manner.

The timing controller 400 generates the data control signal DDC, which is for controlling the operation timing of the data driving circuit 200 based on timing signals (e.g., a vertical synchronization signal Vsync, a horizontal synchronization signal Hsync, a dot clock signal DCLK, and a data enable signal DE), and the gate control signal GDC, which is for controlling the operation timing of the gate driving circuit 300.

During the display operation, the timing controller 400 modulates the digital video data RGB, which is for realizing an image, based on data stored in the memory 500, and transmits the modulated digital video data RGB to the data driving circuit 200.

In some example embodiments, the display device 10 may display an image in units of frames. The amount of time for displaying a single frame may be defined as a vertical period, and the vertical period may be determined by the scan rate of the display device 10. For example, in a case where the scan rate of the display device 50 is 60 Hz, the vertical period may be 1/60 seconds, i.e., about 16.7 msec.

During a single vertical period, the gate driving circuit 300 may scan each of the gate lines 310. The amount of time that it takes for the gate driving circuit 300 to scan each of the gate lines 310 may be defined as a horizontal period, and during a single horizontal period, the data driving circuit 200 may input gray voltages to the pixels P. The gray voltages may be voltages output by the data driving circuit 200 based on the digital video data RGB, and the brightnesses of the pixels P may be determined by the gray voltages.

Referring to FIGS. 2 and 3, the data driving circuit 200 according to an example embodiment of the inventive concepts may include a level shifter 210, a latch circuit 220, a decoder 230, and a buffer circuit 240. In some example embodiments, the buffer circuit 240 may include a plurality of unit buffers UB.

The level shifter 210 may receive the digital video data RGB and may control the operation timings of a plurality of sampling circuits included in the latch circuit 220 in response to the timing control signal DDC. The timing control signal DDC may be a signal having a desired (or alternatively, predetermined) period.

The latch circuit 220 may sample and store the digital video data RGB in accordance with a shift sequence from the level shifter 210. The latch circuit 220 may output sampled image data DQ to the decoder 230. The decoder 230 may include processing circuitry such as hardware including logic circuits; a hardware/software combination such as a processor executing software; or a combination thereof. For example, the processing circuitry more specifically may include, but is not limited to, a central processing unit (CPU), an arithmetic logic unit (ALU), a digital signal processor, a microcomputer, a field programmable gate array (FPGA), a System-on-Chip (SoC), a programmable logic unit, a microprocessor, application-specific integrated circuit (ASIC), etc. In some example embodiments, the decoder 230 may be a digital-analog converter.

In some example embodiments, the latch circuit 220 may include a sampling circuit configured to sample data and a holding latch configured to store the sampled data.

The decoder 230 may receive a plurality of gamma voltages VG and an activation signal FS_EN together with the image data DQ. In some example embodiments, the number of gamma voltages VG may be determined by the bit quantity of the image data DQ. For example, if the image data DQ is 8-bit data, the number of gamma voltages VG may be 256 or less. In another example, if the image data DQ is 10-bit data, the number of gamma voltages VG may be 1024 or less. For convenience, the image data DQ will hereinafter be described as being 8-bit data, and the number of gamma voltages VG will hereinafter be described as being 256.

The buffer circuit 240 may include the unit buffers UB, which are implemented as, for example, operational amplifiers, and the unit buffers UB may be connected to the data lines 290, respectively. As illustrated in FIG. 3, each of the unit buffers UB may include a plurality of input terminals. The decoder 230 may select at least some of the gamma voltages VG based on the image data DQ, and may provide the selected gamma voltages VG to the input terminals of each of the unit buffers UB as input voltages VL and VH. Each of the unit buffers UB may output the average of the input voltages VL and VH, which have been provided from the decoder 230 to the data lines 290, as a gray voltage VOUT. Accordingly, in a case where the image data is 8-bit data, each of the unit buffers may output one of a total of 256 gray voltages, even if the number of gamma lines that input the gamma voltages VG to decoder 230 is less than 256.

The elements 210, 220, 230, and 240 included in the data driving circuit 200 are not particularly limited to the example embodiment of FIG. 2, but may vary.

Figure 4A:
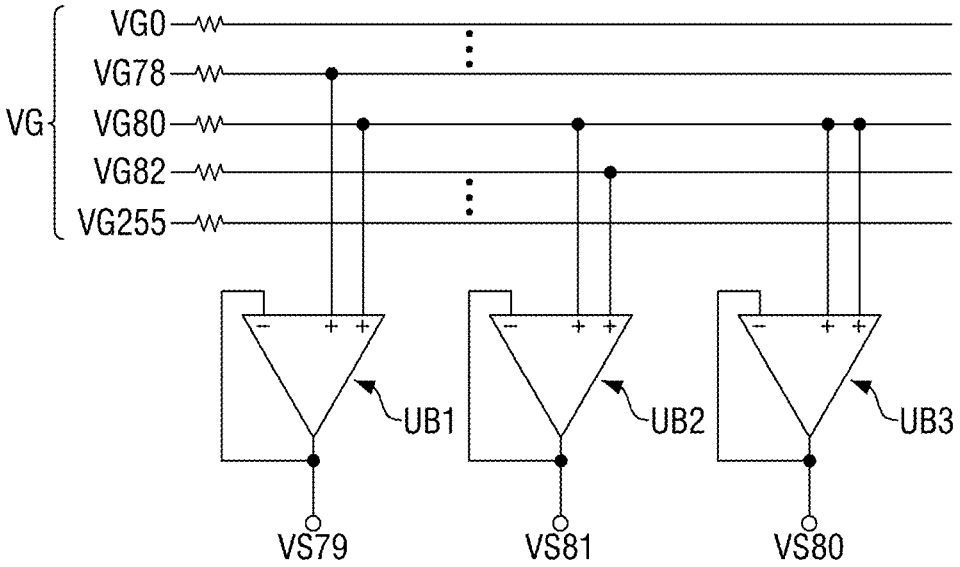
FIGS. 4*a* and 4*b* illustrate problems that may be caused by the resistance of gamma lines in a case where multiple inputs are provided to the buffer circuit of FIG. 2.
Figure 4B:
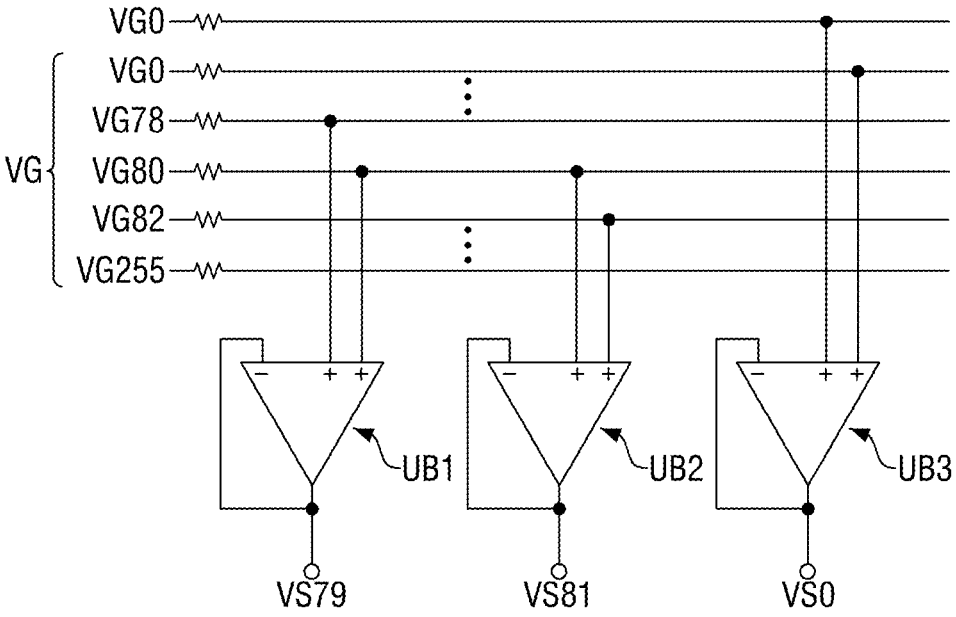

FIGS. 4*a* and 4*b* illustrate problems that may be caused by the resistance of gamma lines in a case where multiple inputs are provided to the buffer circuit of FIG. 2.

Referring to FIG. 4*a*, in a case where a target voltage for a unit buffer UB1 is an output voltage VS79 corresponding to the average of gamma voltages VG78 and VG80, gamma lines to which the gamma voltages VG78 and VG80 are applied are selected, and are then applied to the unit buffer UB1 as inputs. In this case, the resistances of a plurality of gamma lines are in parallel, and may thus be reduced as compared to a case where the input of a buffer is applied via a single gamma line. Thus, slew delays that may be caused by noise from gamma lines may be reduced.

Similarly, in a case where a target voltage for a unit buffer UB2 is an output voltage VS81 corresponding to the average of the gamma voltage VG80 and a gamma voltage VG82, the gamma line to which the gamma voltage VG80 is applied and a gamma line to which the gamma voltage VG82 is applied are selected, and are then applied to the unit buffer UB2 as inputs. Thus, slew delays that may be caused by noise from gamma lines may be reduced.

On the contrary, in a case where a target voltage for a unit buffer UB3 is an output voltage VS80 corresponding to the gamma voltage VG80, a single gamma line to which the gamma voltage VG80 is applied is applied to the unit buffer UB3 as multiple inputs. In this case, the resistance of the single gamma line increases, as compared to a case where the gamma voltage VG80 is transmitted via multiple gamma lines. Thus, slew delays may occur due to noise from gamma lines. In other words, slew delays may be increased compared to the previous case that the gamma voltage VG80 is transmitted via multiple gamma lines.

Referring to FIG. 4*b*, in a case where the target voltage for the unit buffer UB3 is an output voltage VS0 corresponding to a gamma voltage VG0, a gamma line for applying the same gamma voltage VG0 may be additionally provided to reduce the gamma line resistance. In this case, however, the size of an entire chip may increase due to the provision of additional circuitry.

Figure 5:
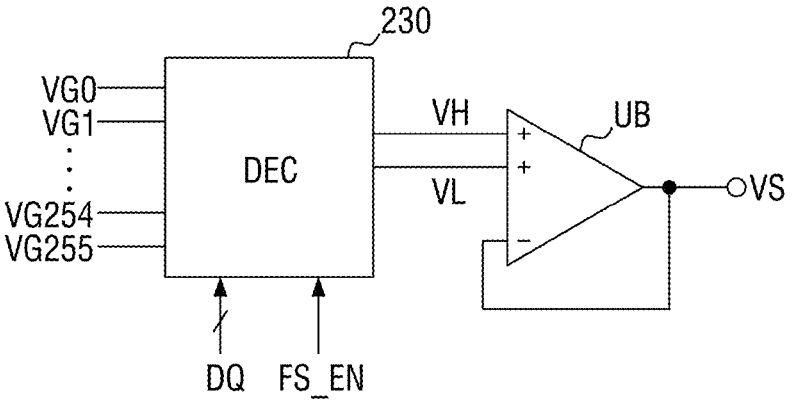
FIG. 5 illustrates a data driving circuit according to an example embodiment of the present inventive concepts.
Figure 6:
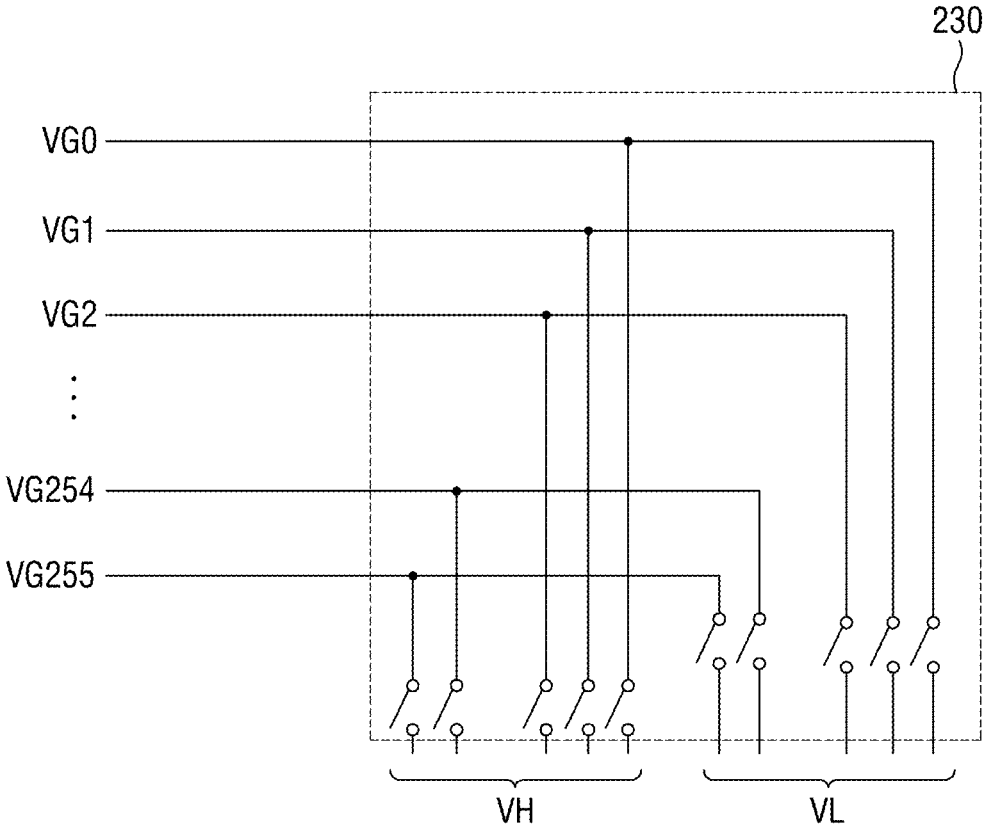
FIG. 6 illustrates the structure of a decoder of FIG. 5.

FIG. 5 illustrates a data driving circuit according to an example embodiment of the present inventive concepts. FIG. 6 illustrates the structure of a decoder of FIG. 5.

Referring to FIG. 5, a decoder 230 may receive image data DQ and an activation signal FS_EN, may determine a target gamma voltage corresponding to an output voltage VS of a unit buffer UB based on the image data DQ, and may select gamma lines corresponding to the target gamma voltage, and may connect the selected gamma lines to two input terminals of the unit buffer UB. That is, gamma voltages applied to the selected gamma lines by decoder 230 may be input to the unit buffer UB as input voltages VH and VL. The decoder 230 may include processing circuitry such as hardware including logic circuits; a hardware/software combination such as a processor executing software; or a combination thereof. For example, the processing circuitry more specifically may include, but is not limited to, a central processing unit (CPU), an arithmetic logic unit (ALU), a digital signal processor, a microcomputer, a field programmable gate array (FPGA), a System-on-Chip (SoC), a programmable logic unit, a microprocessor, application-specific integrated circuit (ASIC), etc.

In some example embodiments, the unit buffer UB may be implemented as an operational amplifier, and may have a negative feedback structure so that the output and inverted input terminals of the unit buffer UB thereof are connected. For example, as illustrated in FIG. 5, the unit buffer UB may include two non-inverted input terminals, and the input voltages VL and VH having different levels from each other may be input to the non-inverted input terminals. For example, the output voltage VS of the unit buffer UB may be determined to be the average of the input voltages VL and VH. The output voltage VS of the unit buffer UB may be a gray voltage to be input to at least one of the data lines 290 included in the display panel 100. Unless specified otherwise, the term "input terminals of a unit buffer", as used herein, may refer to non-inverted input terminals.

Referring to FIG. 6, the decoder 230 according to an example embodiment of the disclosure may include switches which determine whether to transmit voltages to gamma lines. In a case where the unit buffer UB includes two gamma voltage input terminals (+), as illustrated in FIG. 5, terminals for the input voltages VL and VH of the unit buffer UB may be connected to the two gamma voltage input terminals (+) of the unit buffer UB, and each gamma line may be connected to two switches. In some example embodiments, the switches of the decoder 230 may be implemented as transfer transistors that are configured to be gated in accordance with a control signal from the timing controller 400.

The decoder 230 may select gamma voltages to be input during the slew period of the unit buffer UB based on the activation signal FS_EN and may turn on switches connected to the selected gamma voltages. This will hereinafter be described with reference to FIGS. 7 to 8*b*.

Figure 7:
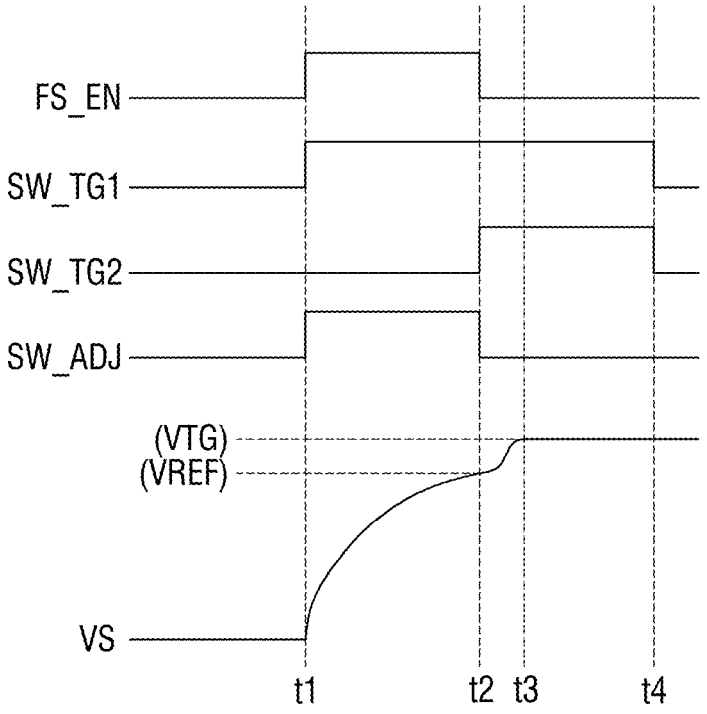
FIG. 7 is a timing diagram for explaining an operation of a data driving circuit according to an example embodiment of the present inventive concepts.
Figure 8A:
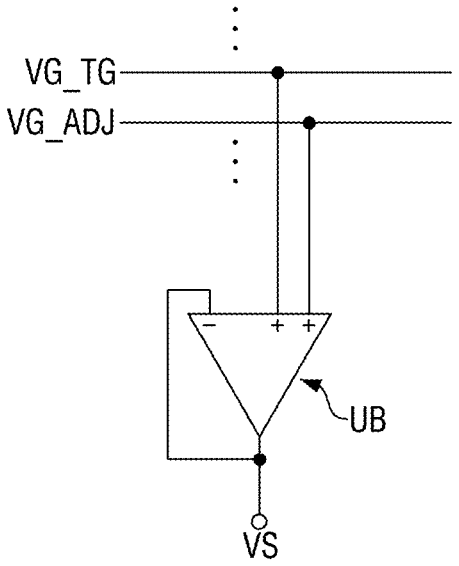
FIGS. 8*a* and 8*b* illustrate how to select gamma lines during the slew period of the data driving circuit according to an example embodiment of the present inventive concepts and FIG. 7.
Figure 8B:
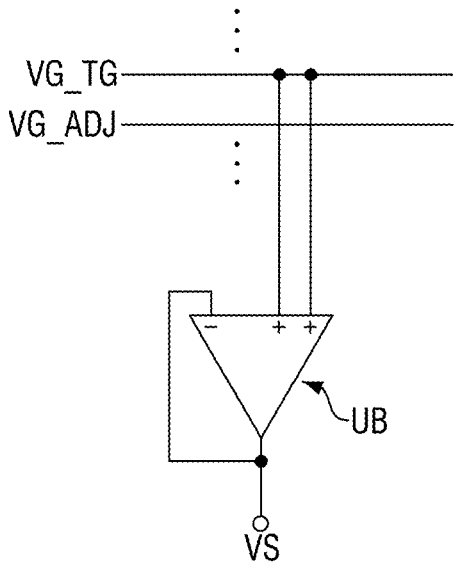

FIG. 7 is a timing diagram for explaining an operation of a data driving circuit according to an example embodiment of the present inventive concepts. FIGS. 8*a* and 8*b* illustrate how to select gamma lines during the slew period of the data driving circuit of FIG. 7.

Referring to FIGS. 7 to 8*b*, a data driving circuit 200 may selectively choose, based on an activation signal FS_EN, gamma lines to be electrically connected to a unit buffer UB during the slew period of the unit buffer UB. In some example embodiments, the activation signal FS_EN may be generated and output by the timing controller 400. Referring to FIG. 7, first and second target switches SW_TG1 and SW_TG2 are defined as switches connected to a gamma line to which a target gamma voltage VG_TG for generating a target voltage VTG is applied, and an adjacent switch SW_ADJ is defined as a switch connected to a gamma line adjacent to the gamma line to which the target gamma voltage VG_TG is applied. In some example embodiments, the first and second target switches SW_TG1 and SW_TG2 may be connected to the same gamma lines or different gamma lines.

Gamma voltages may be applied to the input terminals of the unit buffer UB in a period from a first point t1 to a fourth point t4. That is, the period from the first time t1 and the fourth time t4 is defined as the output voltage generation period of the unit buffer UB. Also, the slew period of the unit buffer UB is defined as a period from the first point t1 to a third point t3. The slew period (0 to t3) of the unit buffer UB may be defined as a period from a point when the output voltage VS of the unit buffer UB begins to increase to a point when the output voltage VS of the unit buffer UB reaches the target voltage VTG. The output voltage generation period (0 to t4) of the unit buffer UB may include the slew period (t1 to t3) of the unit buffer UB.

An operation of the unit buffer UB for generating the output voltage VS may begin at the first point t1. That is, at the first point t1, the decoder 230 may select gamma lines to be applied to the unit buffer UB, and a desired (or alternatively, predetermined) voltage is applied to the input terminals of the unit buffer UB accordingly.

A slew operation of the unit buffer UB may be performed in a period from the first point t1 to the third point t3. That is, at the first point t1, the desired (or alternatively, predetermined) voltage is applied to the input terminals VL and VH of the unit buffer UB so that the output voltage VS begins to increase, and the third point t3 is defined as a point when the output voltage VS reaches the target voltage VTG.

The slew period of the unit buffer UB may include a first period (0 to t2) and a second period (t2 to t3). The first period (0 to t2) is defined as a period from the first point t1 when the output voltage VS begins to increase to the second point t2 when the output voltage VS of the unit buffer UB reaches a desired (or alternatively, predefined) reference voltage VREF, and the second period (t2 to t3) is defined as a period from the second point t2 when the output voltage VS of the unit buffer UB reaches the reference voltage VREF to the third point t3 when the output voltage VS of the unit buffer UB reaches the target voltage VTG. For example, the reference voltage VREF may be set to be as high as 90% of the target voltage VTG.

In the first period (t1 to t2), the decoder 230 may turn on the first target switch SW_TG1 and the adjacent switch SW_ADJ in response to an activation signal FS_EN having a logic high level, and thus a first target gamma voltage VG_TG and an adjacent gamma voltage VG_ADJ may be applied to the unit buffer UB as the input voltages VH and VL.

At the second time t2, the activation signal FS_EN may be switched to a logic low level. The second time t2 may be the time when the output voltage VS of the unit buffer UB reaches the reference voltage VREF.

In the second period (t2 to t3), the decoder 230 may turn on the first and second target switches SW_TG1 and SW_TG2 in response to the activation signal FS_EN having the logic low level, and thus the first target gamma voltage VG_TG and a second target gamma voltage VG_TG may be applied to the unit buffer UB as the input voltages VH and VL.

The output voltage VS of the unit buffer UB reaches the target voltage VTG at the third point t3. Then, the unit buffer UB may transmit the output voltage VS that is as high as the target voltage VTG to the display panel 100 via the data lines 290 as a gray voltage, and the display panel 100 may display an image based on the gray voltage.

Because the adjacent gamma voltage VG_ADJ, instead of the second target gamma voltage VG_TG, is provided to the unit buffer UB as an input voltage, the gamma line resistance in the first period (t1 to t2) can be lowered, and thus the slew period of the unit buffer UB can be shortened according to some example embodiments of the disclosure. Because the adjacent gamma voltage VG_ADJ (instead of a gamma voltage corresponding to the target voltage VTG) is provided, the exact target voltage VTG cannot be achieved. However, because the output voltage VS is raised first to the reference voltage VREF, which is approximate to the target voltage VTG, in the first period (t1 to t2) and is then raised to the target voltage VTG in the second period (t2 to t3) by applying the second target gamma voltage VG_TG, a precise gray voltage can be generated, and the slew period of the unit buffer UB can be shortened.

FIG. 7 illustrates that there are two gamma voltages corresponding to the target voltage VTG (e.g., the first target gamma voltage VG_TG and the second target gamma voltage VG_TG), but the present inventive concepts are not limited thereto. In some example embodiments, a single target gamma voltage may be applied via a single gamma line, as described below with reference to FIGS. 8*a* and 8*b*.

Referring to FIGS. 8*a* and 8*b*, in the first period (t1 to t2), the decoder 230 may turn on switches of gamma lines to which a target gamma voltage VG_TG and an adjacent gamma voltage VG_ADJ are applied, and may apply the target gamma voltage VG_TG and the adjacent gamma voltage VG_ADJ to the unit buffer UB as the input voltages. Thereafter, in the second period (t2 to t3), the decoder 230 may control the switch of the gamma line to which the target gamma voltage VG_TG is applied so that the two input terminals of the unit buffer UB can be connected to the gamma line to which the target gamma voltage VG_TG is applied. That is, in the first period (t1 to t2), the target gamma voltage VG_TG and the adjacent gamma voltage VG_ADJ may be applied to the input terminals of the unit buffer UB by turning on the first target switch SW_TG1 and the adjacent switch SW_ADJ, and in the second period (t2 to t3), the target gamma voltage VG_TG may be input to plurality of input terminals of the unit buffer UB by turning on the first target switch SW_TG1.

FIG. 9 illustrates regions that are classified according to the range of a target gamma voltage, according to an example embodiment of the present inventive concepts. FIG. 10 illustrates sets of gamma lines selected for each target gamma voltage corresponding to a "Full DEC" region of FIG. 9 during a slew period, and FIG. 11 illustrates sets of gamma lines selected for each target gamma voltage corresponding to a "Half DEC" region of FIG. 9 during a slew period.

Referring to FIG. 9, a criterion for selecting gamma lines and a configuration of gamma lines may vary depending on a desired gray voltage. For example, if the target gamma voltage VG_TG is defined as a gamma voltage corresponding to the desired gray voltage, a target gray voltage corresponding to a target gamma voltage VG_TG that ranges from a gamma voltage VG0 to a gamma voltage VG31 or from a gamma voltage VG224 to a gamma voltage VG255 may be defined as a "Full DEC" region, and all gamma lines having a target gamma voltage VG_TG included in the "Full DEC" region may be configured to be connected to the input terminals of the unit buffer UB via the decoder 230. On the contrary, a target gray voltage corresponding to a target gamma voltage VG_TG that ranges from a gamma voltage VG32 to a gamma voltage VG223 may be defined as a "Half DEC" region, and there may selectively exist gamma lines having a target gamma voltage VG_TG included in the "Half DEC" region. For example, among the gamma lines to which the target gamma voltage VG_TG included in the "Half DEC" region is applied, it is assumed that there exist gamma lines to which even-numbered gamma voltages VG32, VG34, . . . , VG220, and VG222 are applied, but there are no gamma lines to which odd-numbered gamma voltages VG33, VG35, . . . , VG221, and VG223 are applied, and an interpolation method can be applied.

Referring to FIG. 10, in a case where the target gamma voltage VG_TG is included in the "Full DEC" region, gamma lines selected when the activation signal FS_EN has a logic high level (e.g., in the first period) may differ from gamma lines selected when the activation signal FS_EN has a logic low level (e.g., in the second period). For example, if the target gamma voltage VG_TG is the gamma voltage VG0, gamma lines to which the gamma voltages VG0 and VG1 are applied may be selected and may then be applied to the unit buffer UB as inputs in the first period, whereas only the gamma line to which the gamma voltage VG0 is applied may be selected in the second period. Accordingly, the gamma voltage VG0 can be input to an input terminal of the unit buffer UB in both the first and second periods. The same method may apply to cases where the target gamma voltage VG_TG is the gamma voltage VG1, the gamma voltage VG254, or the gamma voltage VG255.

Figures 11, 12:
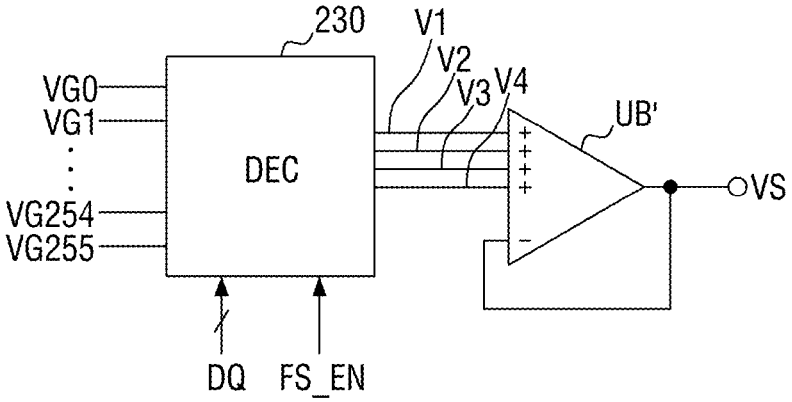
FIG. 11 illustrates sets of gamma lines selected for each target gamma voltage corresponding to a "Half DEC" region of FIG. 9 during a slew period.
FIG. 12 illustrates a data driving circuit according to an example embodiment of the present inventive concepts, which includes a buffer circuit capable of receiving four input voltages.

Referring to FIG. 11, in a case where the target gamma voltage VG_TG is included in the "Half DEC" region, gamma lines selected in the first period may be the same as, or different from, gamma lines selected in the second period.

For example, if the target gamma voltage VG_TG is the gamma voltage VG128 or the gamma voltage VG130 (e.g., an even-numbered gamma voltage), there exists a gamma line to which the even-numbered gamma voltage is applied, and thus the gamma voltages applied to the unit buffer UB as inputs in the first and second periods may differ, as described above with reference to FIG. 10.

On the contrary, if the target gamma voltage VG_TG is the gamma voltage VG129 or the gamma voltage VG131 (e.g., an odd-numbered gamma voltage), there exists no particular gamma line to which the odd-numbered gamma voltage is applied, and thus a gray voltage is generated by an interpolation method. That is, problems (e.g., an increase in gamma line resistance) that may arise when there are multiple target gamma voltages VG_TG for generating a gray voltage and the multiple target gamma voltages VG_TG are to be applied via a single gamma line can be prevented, by configuring the gamma voltages applied in the first and second periods to be the same.

Figure 13A:
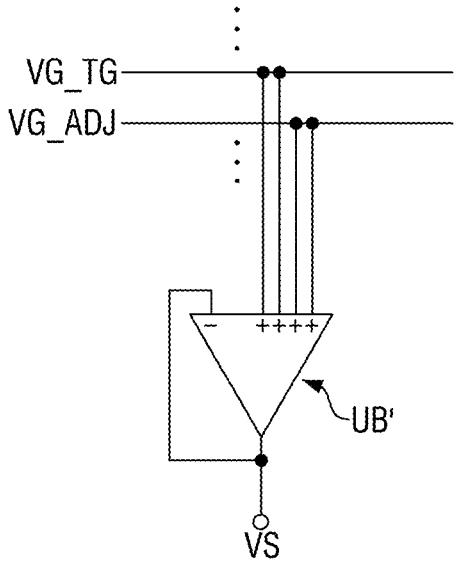
FIGS. 13*a* to 13*c* illustrate gamma lines selected during the slew period of the data driving circuit of FIG. 12.
Figure 13B:
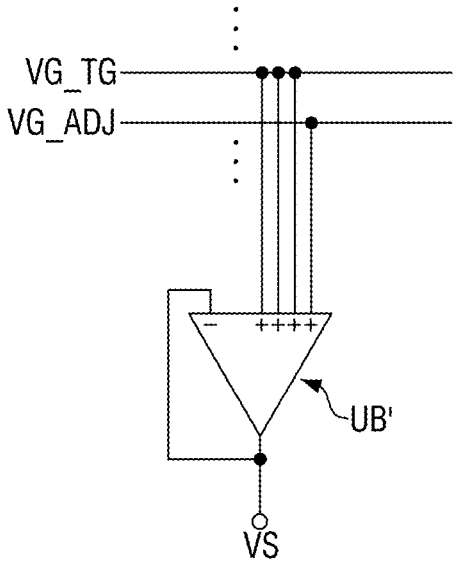
Figure 13C:
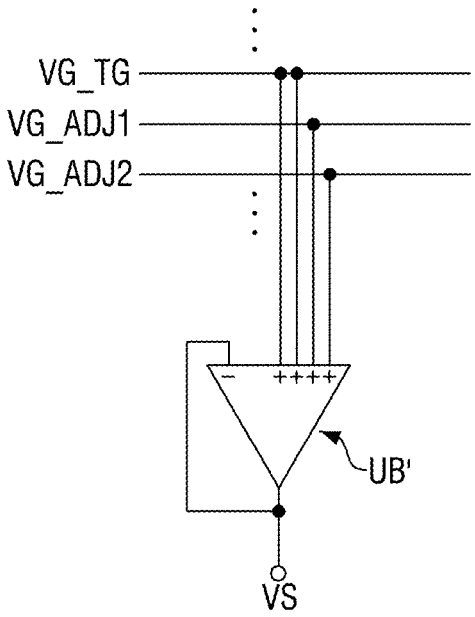

FIG. 12 illustrates a data driving circuit according to an example embodiment of the present inventive concepts, which includes a buffer circuit capable of receiving four input voltages, and FIGS. 13*a* to 13*c* illustrate gamma lines selected during the slew period of the data driving circuit of FIG. 12.

Referring to FIGS. 12 to 13*c*, a unit buffer UB' may be configured to include three or more non-inverted input terminals. As illustrated in FIG. 12, the unit buffer UB' may include four non-inverted input terminals configured to receive four input voltages V1, V2, V3 and V4, respectively. In this case, an adjacent gamma voltage VG_ADJ in a first period of the slew period of the unit buffer UB' may vary. For example, as illustrated in FIG. 13*a*, a decoder 230 may select, in the first period, as many gamma lines to which the adjacent gamma voltage VG_ADJ is applied as the number of gamma lines to which a target gamma voltage VG_TG is applied, and may apply the selected gamma lines to the unit buffer UB' as inputs. In another example, as illustrated in FIG. 13*b*, the decoder 230 may select a different number of gamma lines to which the adjacent gamma voltage VG_ADJ is applied, from the number of gamma lines to which the target gamma voltage VG_TG is applied, and may apply the selected gamma lines to the unit buffer UB' as inputs. In yet another example, as illustrated in FIG. 13*c*, the decoder 230 may select multiple adjacent gamma lines in the first period. That is, the decoder 230 may select gamma lines to which the target gamma voltage VG_TG, first adjacent gamma voltage VG_ADJ and second adjacent gamma voltages VG_ADJ are applied, and may then apply the selected gamma lines to the unit buffer UB' as inputs. In this case, the number of gamma lines selected is not particularly limited, but may vary.

Figure 14:
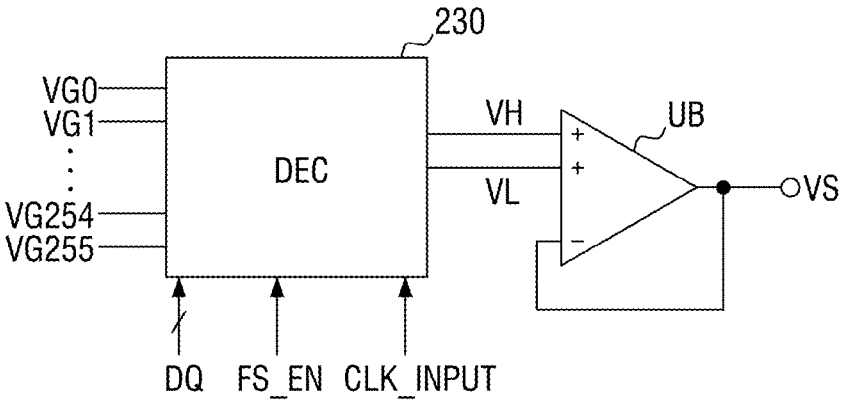
FIG. 14 illustrates a data driving circuit configured to receive an activation signal FS_EN, which is generated based on an input clock signal according to an example embodiment of the present inventive concepts.
Figure 15:
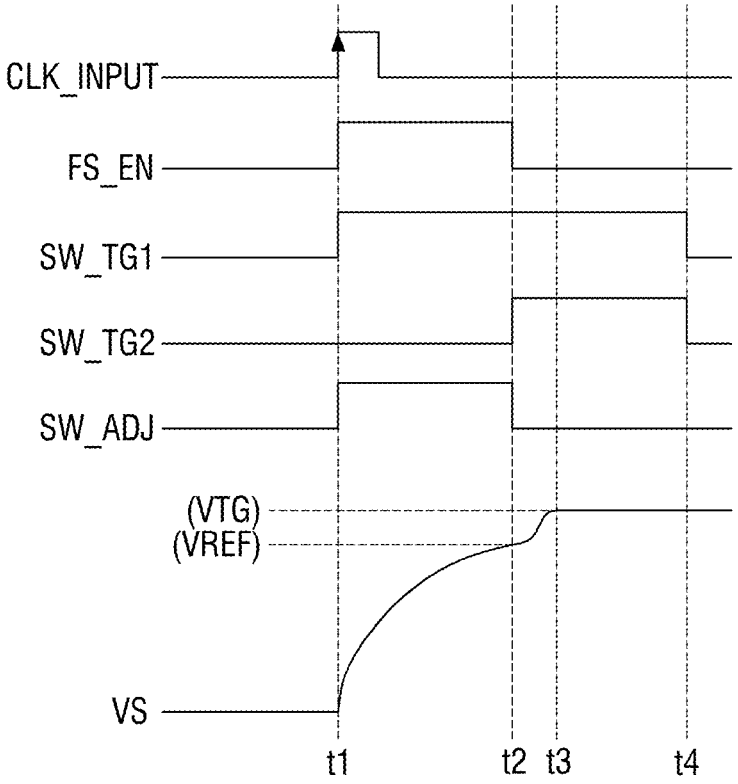
FIG. 15 is a timing diagram illustrating an operation of the data driving circuit of FIG. 14.

FIG. 14 illustrates a data driving circuit configured to receive an activation signal FS_EN, which is generated based on an input clock signal, according to an example embodiment of the present inventive concepts. FIG. 15 is a timing diagram illustrating an operation of the data driving circuit of FIG. 14.

Referring to FIGS. 14 and 15, a data driving circuit 200 may receive a trigger signal CLK_INPUT which triggers the generation of an output voltage VS of an unit buffer UB, an activation signal FS_EN which defines first and second periods, and image data DQ, may select gamma lines based on the trigger signal CLK_INPUT, the activation signal FS_EN, and the image data DQ, and may connect the selected gamma lines to the input terminals of the unit buffer UB.

In some example embodiments, the trigger signal CLK_INPUT may be a signal initiating the generation of the output voltage VS of the unit buffer UB, and the decoder 230 may start the selection of gamma lines in response to a rising edge of the trigger signal CLK_INPUT. In some example embodiments, the activation signal FS_EN may be controlled based on the trigger signal CLK_INPUT. That is, the activation signal FS_EN may be switched to a logic high level in response to the rising edge of the trigger signal CLK_INPUT and may then maintain the logic high level for a desired (or alternatively, predefined) amount of time. A subsequent operation of the data driving circuit 200 in accordance with the activation signal FS_EN may be substantially the same as that described above with reference to FIG. 7.

Figure 16:
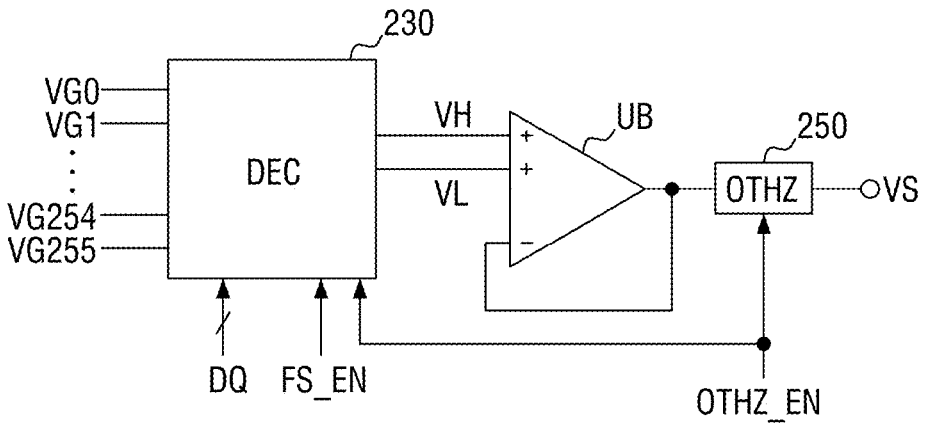
FIG. 16 illustrates a data driving circuit including an output control circuit according to an example embodiment of the present inventive concepts.
Figure 17:
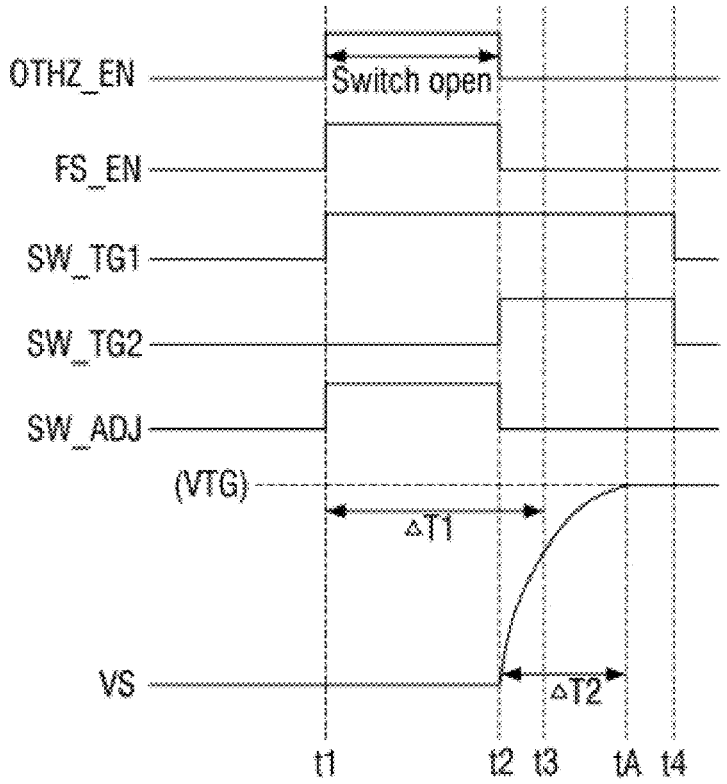
FIG. 17 is a timing diagram illustrating an operation of the data driving circuit of FIG. 16.

FIG. 16 illustrates a data driving circuit according to an example embodiment of the present inventive concepts, which includes an output control circuit, and FIG. 17 is a timing diagram illustrating an operation of the data driving circuit of FIG. 16.

Referring to FIGS. 16 and 17, a data driving circuit 200 may further include an output control circuit "OTHZ" 250. In some example embodiments, the output control circuit 250 may be connected to the output terminal of a unit buffer UB and may include a switch which connects the output voltage VS of the unit buffer UB to the display panel 100. That is, the output control circuit 250 may determine whether to turn on or off the switch in accordance with an output activation signal OTHZ_EN. For example, in a period when the output activation signal OTHZ_EN has a logic low level, the switch may be turned on so that the output voltage VS may be output to the display panel 100, and in a period when the output activation signal OTHZ_EN has a logic high level, the switch may be turned off or opened so that the output voltage VS may not be output to the display panel 100.

In some example embodiments, an activation signal FS_EN may be activated in the period when the output activation signal OTHZ_EN has a logic high level. In this case, the output voltage VS may be maintained at its initial level in a period when the switch of the output control circuit 250 is open (e.g., in a period from a first point t1 to a second point t2 (when the activation signal FS_EN is activated)), and after the second point t2 when the switch of the output control circuit 250 is turned on, a slew period may be generated. In this case, noise generated in the process of inputting a first target gamma voltage VG_TG and an adjacent gamma voltage VG_ADJ to the unit buffer UB in the period from the first point t1 to the second point t2 is not reflected, and the output voltage VS begins to increase after the input voltages of the unit buffer UB are raised to a desired (or alternatively, predetermined) level. Thus, the slew period (e.g., the period from the second point t2 to a point to when the output voltage VS reaches a target voltage VTG) can be shortened. The length of the slew period according to the example embodiment of FIG. 17 when the output voltage VS starts to increase and reaches the target voltage VTG after the second point t2 in accordance with the output activation signal OTHZ_EN (e.g., a second slew period duration ΔT2) can be further reduced as compared to the length of the slew period when the output voltage VS increases and reaches the target voltage VTG according to the embodiment of FIG. 17 (e.g., a first slew period duration ΔT1).

Figure 18:
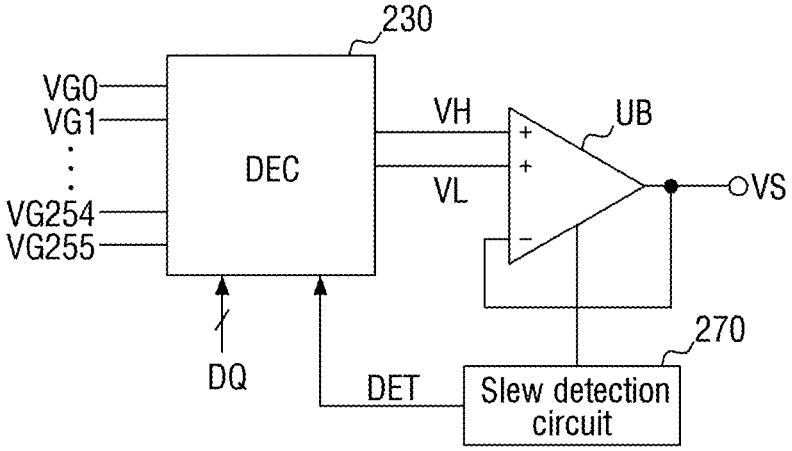
FIG. 18 illustrates a data driving circuit including a slew detection circuit according to an example embodiment of the present inventive concepts.
Figure 19:
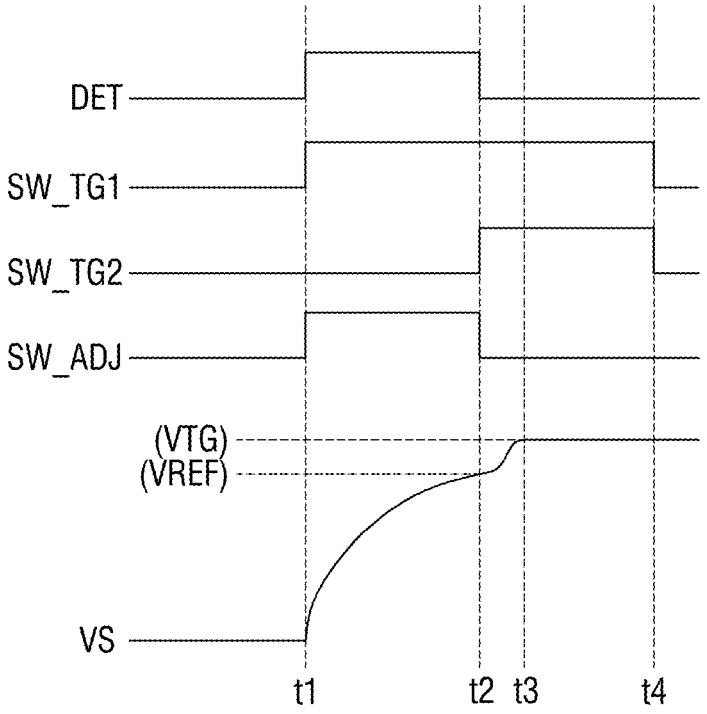
FIG. 19 is a timing diagram illustrating an operation of the data driving circuit of FIG. 18.

FIG. 18 illustrates a data driving circuit including a slew detection circuit according to an example embodiment of the present inventive concepts. FIG. 19 is a timing diagram illustrating an operation of the data driving circuit of FIG. 18.

Referring to FIGS. 18 and 19, according to some example embodiments of the present inventive concepts, a data driving circuit 200 may further include a slew detection circuit 270. The slew detection circuit may track the output voltage of the buffer circuit 240. For example, the slew detection circuit 270 may track a slew operation performed by a unit buffer UB, and may output a detection signal DET based on the result of the tracking. In some example embodiments, the detection signal DET may include information regarding the time when an output voltage VS of the unit buffer UB reaches a reference voltage VREF. For example, as illustrated in FIG. 19, the detection signal DET may be switched to a logic high level when the slew operation of the unit buffer UB begins (e.g., when the output voltage VS of the unit buffer UB begins to increase), and may then be switched to a logic low level when the output voltage VS reaches the reference voltage VREF. That is, the aforementioned operation performed in accordance with the activation signal FS_EN of FIG. 7 can be performed in accordance with the detection signal DET. In other words, the operation of the data driving circuit 200 in accordance with the detection signal DET of FIG. 19 may be the same as or substantially similar to the operation of the data driving circuit 200 in accordance with the activation signal FS_EN of FIG. 7.

While the present inventive concepts has been particularly shown and described with reference to some example embodiments thereof, it will be understood by those of ordinary skill in the art that various changes in form and detail may be made therein without departing from the spirit and scope of the present inventive concepts as defined by the following claims. Therefore, the example embodiments described above should be considered in a descriptive sense only and not for purposes of limitation.

What is claimed is:

1. A source driver comprising:

a decoder configured to, receive image data and an activation signal, determine a target voltage based on the image data, and select at least one gamma line for generating the target voltage from among a plurality of gamma lines, the plurality of gamma lines being configured to transmit different gamma voltages, respectively; and a buffer circuit including a plurality of input terminals, the buffer circuit configured to be connected to the selected at least one gamma line, the buffer circuit further configured to generate an output voltage based on at least one gamma voltage obtained from the selected at least one gamma line, wherein the decoder is further configured to select another gamma line and connect the at least one gamma line and the another gamma line to the plurality of input terminals of the buffer circuit during a slew period of the buffer circuit in accordance with the activation signal.

2. The source driver of claim 1, wherein the selected at least one gamma line and the another gamma line are two adjacent gamma lines from among the plurality of gamma lines.

3. The source driver of claim 2, wherein the slew period includes a first period and a second period, the first period being a period from a first point in time when the slew period begins to a second point in time when the output voltage of the buffer circuit reaches a reference voltage, the second period being a period from the second point in time to a third point in time when the output voltage of the buffer circuit reaches the target voltage, and the decoder is configured to select the selected at least one gamma line and the another gamma line in the first period and select the selected at least one gamma line for generating the target voltage in the second period.

4. The source driver of claim 2, wherein the slew period includes a first period and a second period, the first period being a period from a first point in time when the slew period begins to a second point in time when the output voltage of the buffer circuit reaches a reference voltage, the second period being a period from the second point in time to a third point in time when the output voltage of the buffer circuit reaches the target voltage, and the decoder configured to determine two or more of the plurality of gamma lines to be selected in the first period and two or more of the plurality of gamma lines to be selected in the second period, based on the activation signal and the target voltage.

5. The source driver of claim 4, wherein when the target voltage is higher than a first level or lower than a second level, which is lower than the first level, the decoder is configured to select a target gamma line to which a voltage for generating the target voltage is applied and an adjacent gamma line adjacent to the target gamma line in the first period, and select only the target gamma line in the second period.

6. The source driver of claim 4, wherein when the target voltage is between a first level and a second level, the decoder is configured to determine two or more of the plurality of gamma lines to be selected in the first period and the same two or more of the plurality of gamma lines to be selected in the second period, based on whether a gamma line, from among the plurality of gamma lines, to which a target gamma voltage for generating the target voltage is applied exists.

7. The source driver of claim 6, wherein when the gamma line to which the target gamma voltage for generating the target voltage is applied exists, the decoder is configured to, select the gamma line as a target gamma line and an adjacent gamma line adjacent to the target gamma line in the first period, and select the target gamma line in the second period, and when the gamma line to which the target gamma voltage for generating the target voltage is applied does not exist, the decoder is configured to select same multiple gamma lines for generating the target voltage from among the plurality of gamma lines in both the first period and the second period.

8. The source driver of claim 2, further comprising:

an output switch connected to an output terminal of the buffer circuit, the output switch configured to be turned on after the slew period of the buffer circuit in accordance with a switch activation signal and output the output voltage of the buffer circuit to an outside of the source driver.

9. The source driver of claim 2, further comprising:

a slew detection circuit configured to track the output voltage of the buffer circuit, wherein the decoder is further configured to receive a detection signal output by the slew detection circuit as the activation signal.

10. A source driver comprising:

a decoder configured to, receive image data and an activation signal, determine a target voltage based on the image data, receive a plurality of gamma voltages having different levels, and select a gamma voltage, from among the plurality of gamma voltages, to be output based on the activation signal and the target voltage; and a buffer circuit including a plurality of input terminals to which the gamma voltage is applied, the buffer circuit configured to generate an output voltage based on the gamma voltage, wherein the decoder is further configured to, select first gamma voltages in a first period from a first point in time when a slew period of the buffer circuit begins to a second point in time when the output voltage reaches a reference voltage, the first gamma voltages including two or more gamma voltages having similar levels from among the plurality of gamma voltages, and select second gamma voltages in a second period from the second point in time to a third point in time when the output voltage reaches the target voltage, the second gamma voltages including at least one gamma voltage for generating the target voltage from among the plurality of gamma voltages.

11. The source driver of claim 10, wherein the first period is defined as a period when the activation signal is in a logic high level, the second period is defined as a period when the activation signal is in a logic low level, and the decoder is further configured to select the first gamma voltages or the second gamma voltages based on a logic level of the activation signal.

12. The source driver of claim 10, wherein when the target voltage is lower than a first voltage or higher than a second voltage, which is higher than the first voltage, the decoder is configured to receive a single gamma voltage, from among the plurality of gamma voltages, corresponding to the target voltage and select different gamma voltages as the first gamma voltages and the second gamma voltages, and when the target voltage is between the first and second voltages, the decoder is configured to receive the at least one gamma voltage for generating the target voltage and select same gamma voltages or different gamma voltages as the first gamma voltages and the second gamma voltages.

13. The source driver of claim 10, wherein when the target voltage is lower than a first voltage or higher than a second voltage, which is higher than the first voltage, and a specific gamma voltage, from among the plurality of gamma voltages, corresponding to the target voltage is received, the decoder is configured to select different gamma voltages as the first gamma voltages and the second gamma voltages, and when the target voltage is between the first voltage and the second voltage and the specific gamma voltage, from among the plurality of gamma voltages, corresponding to the target voltage is not received, the decoder is configured to select same gamma voltages as the first gamma voltages and the second gamma voltages.

14. The source driver of claim 10, further comprising:

an output switch connected to an output terminal of the buffer circuit, the output switch configured to be turned on after the second period in accordance with a switch activation signal and output the output voltage of the buffer circuit.

15. The source driver of claim 10, further comprising:

a slew detection circuit configured to track the output voltage of the buffer circuit, wherein the decoder is further configured to receive a detection signal output by the slew detection circuit as the activation signal.

16. A display device comprising:

a display panel including a plurality of pixels and configured to display an image via the plurality of pixels;

a source driver connected to a plurality of gamma lines which transmit different gamma voltages, respectively, the source driver configured to output a gray voltage to the plurality of pixels via a plurality of source lines; and a timing controller configured to output control signals for controlling an operation of the source driver, wherein the source driver includes, a decoder configured to receive image data and an activation signal from the timing controller, determine a target voltage based on the image data, and select at least one gamma line for generating the target voltage from among the plurality of gamma lines, and a buffer circuit including a plurality of input terminals, the buffer circuit configured to be connected to the selected at least one gamma line, the buffer circuit further configured to generate the gray voltage based on a target gamma voltage obtained from the selected at least one gamma line, and wherein the decoder is further configured to select another gamma line and connect the at least one gamma line and another gamma line to the plurality of input terminals in a slew period of the buffer circuit in accordance with the activation signal.

17. The display device of claim 16, wherein the decoder is configured to, select a plurality of adjacent gamma lines from among the plurality of gamma lines in a first period from a first point in time when the slew period of the buffer circuit begins to a second point in time when the gray voltage reaches a reference voltage, and select the at least one gamma line for generating the target voltage from among the plurality of gamma lines in a second period from the second point in time to a third point in time when the gray voltage reaches the target voltage.

18. The display device of claim 16, wherein the slew period includes a first period from a first point in time when the slew period of the buffer circuit begins to a second point in time when the gray voltage reaches a reference voltage and a second period from the second point in time to a third point in time when the gray voltage reaches the target voltage, when the target voltage is higher than a first voltage or lower than a second voltage, which is lower than the first voltage, the decoder is configured to, select a target gamma line to which the target gamma voltage for generating the target voltage is applied and an adjacent gamma line adjacent to the target gamma line, in the first period, and select only the target gamma line in the second period, and when the target voltage is between the first voltage and the second voltage, the decoder is configured to determine specific gamma lines, from among the plurality of gamma lines, to be selected in both the first period and the second period based on whether the target gamma line to which the target gamma voltage for generating the target voltage is applied exists.

19. The display device of claim 18, wherein when the target gamma line to which the target gamma voltage for generating the target voltage is applied exists, the decoder is configured to select the target gamma line and the adjacent gamma line in the first period, and select only the target gamma line in the second period, and when the target gamma line to which the target gamma voltage for generating the target voltage is applied does not exist, the decoder is configured to select same two or more gamma lines, from among the plurality of gamma lines, for generating the target voltage in both the first period and the second period.

20. The display device of claim 16, wherein the timing controller is configured to, generate a trigger signal that triggers an output of the gray voltage, and output the activation signal, which switches to a logic high level in response to a rising edge of the trigger signal, and the decoder is configured to select at least one of the at least one gamma line and the another gamma line based on a logic level of the activation signal.

* * * * *